US011034480B2

(12) United States Patent
Vitale

(10) Patent No.: US 11,034,480 B2
(45) Date of Patent: Jun. 15, 2021

(54) HOLDER FOR CURVED-SURFACE OBJECTS

(71) Applicant: Dean C. Vitale, New Smyrna Beach, FL (US)

(72) Inventor: Dean C. Vitale, New Smyrna Beach, FL (US)

( * ) Notice: Subject to any disclaimer, the term of this patent is extended or adjusted under 35 U.S.C. 154(b) by 37 days.

(21) Appl. No.: 16/392,581

(22) Filed: Apr. 23, 2019

(65) Prior Publication Data

US 2019/0329927 A1 Oct. 31, 2019

Related U.S. Application Data

(60) Provisional application No. 62/662,267, filed on Apr. 25, 2018, provisional application No. 62/744,247, filed on Oct. 11, 2018.

(51) Int. Cl.
*B65D 1/36* (2006.01)
*B65D 5/50* (2006.01)

(52) U.S. Cl.
CPC ..... *B65D 1/36* (2013.01); *B65D 5/503* (2013.01)

(58) Field of Classification Search
CPC ..... B65D 5/503; B65D 1/36; B65G 17/32; B65G 17/36; B65G 2201/0261
USPC ..... 206/523–524, 589, 591, 564, 194; 198/456, 803.14
See application file for complete search history.

(56) References Cited

U.S. PATENT DOCUMENTS 3,439,798 A * 4/1969 James ..... B65D 73/005 206/149
4,173,286 A * 11/1979 Stanko ..... B65D 81/022 206/433
5,040,678 A * 8/1991 Lenmark, Sr. ..... B65D 81/107 206/204
5,320,223 A * 6/1994 Allen ..... B25H 3/06 206/372
5,409,560 A * 4/1995 Hammer ..... B25H 3/003 156/248
6,981,589 B2 * 1/2006 Sanders, Jr. ..... B65D 5/22 206/320
7,410,053 B2 * 8/2008 Bowen ..... B25H 3/06 206/370
8,152,002 B2 * 4/2012 Gibert Guasch ..... B65D 71/70 211/59.4
8,240,474 B1 * 8/2012 Mossberg ..... B65D 81/025 206/449
2006/0091031 A1 * 5/2006 Bowen ..... B25H 3/06 206/372

* cited by examiner

*Primary Examiner* — Chun Hoi Cheung
(74) *Attorney, Agent, or Firm* — Wilson Dutra PLLC; Camille A. Wilson

(57) ABSTRACT

The present disclosure provides for a system and device that may limit rolling and shifting of curved-surface objects on a movable surface. More specifically, the system and device may comprise a holder with a frame and openings configured to fit curved-surface objects. In some aspects, a holder may be configured to fit a particular movable surface, such as a grocery cart, conveyor belt, or car trunk, as non-limiting examples. In some embodiments, the sizes and shapes of the openings may be configured to accept certain types or sizes of curved-surface objects.

9 Claims, 11 Drawing Sheets

HOLDER FOR CURVED-SURFACE OBJECTS

CROSS-REFERENCE TO RELATED APPLICATION

This application claims priority to and the full benefit of U.S. Provisional Patent Application Ser. No. 62/662,267 (filed Apr. 25, 2018, and titled "Bottle Cradle") and Provisional Patent Application Ser. No. 62/744,247 (filed Oct. 11, 2018, and titled "Holder for Curved-Surface Objects"), the entire contents of both are incorporated here by reference.

BACKGROUND OF THE DISCLOSURE

The grocery industry is about an $800 billion industry, with an average supermarket generating $15-$20 million in revenues per year. Approximately 50% of sales come from items in displays and in shelves, with the rest a mixture from the frozen food, deli, and bakery sections. One of the challenges stores face is how to protect curved-surface objects from breaking once those items are in a customer's possession.

Curved-surface objects such as bottles, cans, or food items, such as melons, are often placed on conveyor belts. For example, in grocery stores, curved-surface items may be placed on conveyor belts at a cashier. A conveyor belt may move automatically depending on the actions of a cashier or other customer. Conveyor belts may intermittently increase or decrease their speed to provide time for a cashier to scan or bag items. Placing curved-surface objects on intermittently accelerating conveyors carries a risk of any curved-surface objects rolling and potentially falling off the conveyor, more so than a stationary container would.

For example, a bottle is a narrow-necked, curved-surface container made of an impermeable material, such as plastic, glass, or metal, configured to store and transport liquids. In modern usage a bottle may be sealed with an internal stopper, external bottle cap, or one of various closure devices. By contrast, a can is a container for storing and transporting liquids that has a substantially consistent diameter along its entire length. Such cans generally comprise a metal material of construction and implement a stay-tab opening mechanism.

Bottles and cans may include a substantially cylindrical main body that have a constant diameter along a length of the cylindrical main body. Bottles and cans may be taller in height than they are wide in diameter. This may result in bottles and cans being more easily toppled or getting knocked over for slight disturbances. For example, placing bottles and cans upright on a conveyor belt often results in bottles toppling over when the belt conveyor system starts or stops. Laying bottles and cans horizontally on the belt normally does not remedy the problem, since the inconsistency of motion of the conveyor belt may cause the bottles and cans to roll from their initial position. In a system without an edge buffer, items may roll off the conveyor belt, causing breakage and spoilage of the products at issue.

As another example, other curved-surface objects such as melons or watermelons are known to hold significant rotational inertia due to their radii and mass distribution, and if they roll on a conveyor belt they may not stop rolling, and fall off the conveyor belt.

Curved-surface objects may also tumble out and break when they are in items in motion, particularly when curved-surface items make their way from person to grocery carts to cars to wherever they end up. There are multiple points in this journey that can result in breakage, resulting in monetary loss to a store or costing a customer money if they break something after leaving a store.

SUMMARY OF THE DISCLOSURE

What is needed is a system and device to prevent or limit rolling of objects on a movable surface. Accordingly, the present disclosure provides for a system and device that may limit rolling and shifting of curved-surface objects on a movable surface. More specifically, the system and device may comprise a holder with a frame and openings configured to fit curved-surface objects. In some aspects, a holder may be configured to fit a particular movable surface, such as a grocery cart, conveyor belt, or car trunk, as non-limiting examples. In some embodiments, the sizes and shapes of the openings may be configured to accept certain types or sizes of curved-surface objects.

In some implementations, a holder may be configurable based on customer need. For example, a holder may have cutouts that an individual can remove based on the size or quantity of curved-surface objects they would like to protect. In some aspects, a holder may be padded to hold heavier curved-surface objects. In some embodiments, a holder may be insulated to maintain a curved-surface object's temperature, such as when it was in a refrigerator or in a storage section. In some implementations, a holder may have a container that may seal the items within the holder. In some aspects, a holder may have openings that may prevent curved-surface objects from rolling.

The present disclosure relates to a holder for curved-surface objects comprising a frame comprising a substantially planar shape with a plurality of openings configured to stabilize curved-surface objects when the frame is placed on a movable surface, wherein the stabilizing limits rolling of the curved-surface objects when the movable surface is moving. In some aspects, each of the plurality of openings may comprise a reinforcing frame around at least a portion of each of the plurality of openings. In some embodiments, the frame may comprise a disposable material, a reusable material, or combinations.

In some implementations, at least a portion of the plurality of openings may comprise a backing, wherein the backing provides a protective layer between the movable surface and the curved-surface objects. In some aspects, the plurality of openings may comprise a plurality of one or both shapes and sizes. The holder may stabilize a top set of curved-surface objects and a second holder may stabilize a bottom set of curved-surface objects, wherein the holder is stackable on the second holder.

In some embodiments, the frame may be configured to fit in a grocery cart. In some implementations, the frame may be configured to fit on a conveyor belt. In some aspects, the holder may further comprise a handle. The holder may further comprise a hanging device, wherein the hanging device may allow the holder to hang from a substantially vertical surface.

The present disclosure relates to a holder for curved-surface objects comprising a frame comprising a substantially planar shape with a plurality of removable panels, wherein removing each of the plurality of removable panels creates an opening configured to stabilize a curved-surface object when the frame is placed on a movable surface, wherein the stabilizing limits rolling of the curved-surface objects when the movable surface is moving. In some aspects, the frame may comprise a disposable material, a reusable material, or combinations thereof.

In some aspects, the plurality of removable panels may be one-time use and not replaceable to cover the opening. In some embodiments, the plurality of removable panels may be replaceable to recover each opening. The plurality of removable panels may comprise a plurality of one or both shapes and sizes. In some implementations, the holder may stabilize a top set of curved-surface objects and a second holder may stabilize a bottom set of curved-surface objects, and wherein the holder is stackable on the second holder. In some aspects, each opening may comprise a reinforcing frame around at least a portion of the opening. In some embodiments, each opening may comprise a backing, wherein the backing provides a protective layer between the movable surface and the curved-surface objects.

BRIEF DESCRIPTION OF THE DRAWINGS

The accompanying drawings, that are incorporated in and constitute a part of this specification, illustrate several embodiments of the disclosure and, together with the description, serve to explain the principles of the disclosure.

DETAILED DESCRIPTION

The present disclosure provides generally for a system and device that limits rolling and shifting of curved-surface objects on a movable surface. More specifically, the system and device may comprise a holder with openings configured to fit curved-surface objects. According to the present disclosure, a holder may be configured to fit a particular movable surface, such as a grocery cart, conveyor belt, or car trunk, as non-limiting examples.

In the following sections, detailed descriptions of examples and methods of the disclosure will be given. The description of both preferred and alternative examples though thorough are exemplary only, and it is understood that to those skilled in the art variations, modifications, and alterations may be apparent. It is therefore to be understood that the examples do not limit the broadness of the aspects of the underlying disclosure as defined by the claims.

Glossary

Curved-Surface Object: as used herein refers to any object that may be prone to rolling. A curve-surface object may comprise a spherical shape, such as a ball, melon, or orange. A curve-surface object may comprise a cylindrical shape or cylindrical body, such as a can, bottle, or jar.

Holder: as used herein refers to a device that may accept and stabilize curved-surface objects. In some aspects, a holder may comprise a substantially planar frame with a plurality of openings configured to stabilize curved-surface objects when the frame is placed on a movable surface, wherein the stabilizing limits rolling of the curved-surface objects when the movable surface is moving. A holder may comprise openings of a range of sizes and shapes, such as depending on the type of goods to stabilize.

Movable Surface: as used herein refers to a surface that is configured to move or to be in motion. In some aspects, the surface itself may be movable, such as with a conveyor belt. In some embodiments, the surface may be part of a movable object, such as a cart or car. A movable surface is in contrast to stationary objects, such as shelving.

Figure 1B:
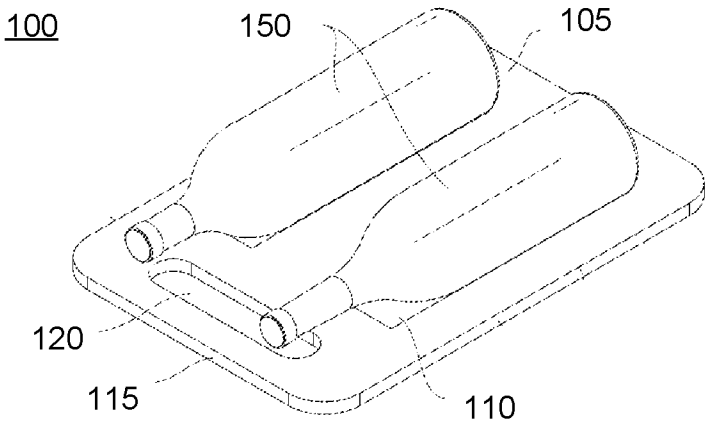
FIG. 1B illustrates an exemplary holder with curved-surface objects, according to some embodiments of the present disclosure.
Figure 1A:
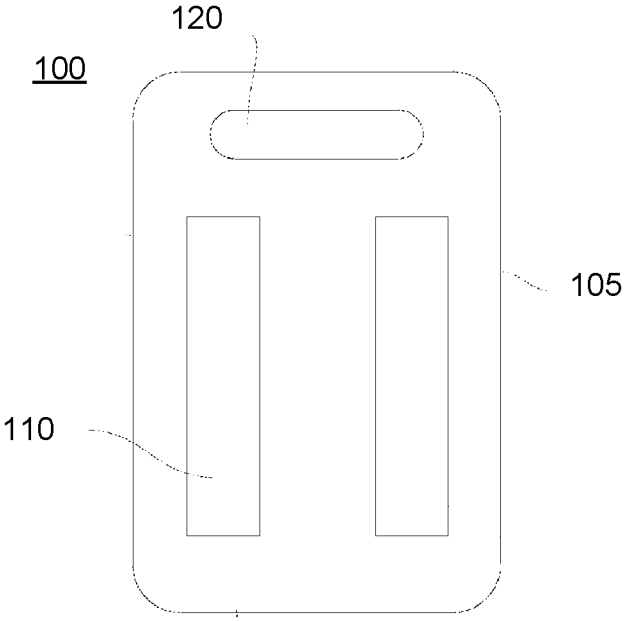
FIG. 1A illustrates an exemplary holder for curved-surface objects, according to some embodiments of the present disclosure.

Referring now to FIG. 1A, an exemplary holder 100 for curved-surface objects is illustrated. In some aspects, a holder 100 may comprise a frame 105 with openings 110 configured to accept curved-surface objects. In some embodiments, the holder 100 may comprise a handle 120, which may allow for easy carrying and storage. For example, a user may be able to keep the holder 100 in their car and easily grab it by the handle 120 to bring into a store. In some implementations, the openings 110 may comprise a size and shape for a particular curved-surface objects. For example, the openings 110 may be configured for a standard wine bottle.

Referring now to FIG. 1B, an exemplary holder 100 with curved-surface objects 150, according to some embodiments of the present disclosure. In some aspects, the curved-surface objects 150 may be placed within the openings 110, wherein the placement may limit rolling and motion. In some implementations, the frame 105 may comprise a reinforcement layer 115 that may provide increased durability.

The holder 100 may comprise a range of materials. Where the holder 100 may be a consumer product, the holder 100 may comprise a reusable material with aesthetic appeal, such as coated foam, silicone, plastic, or reinforced fabric, wherein the holder 100 may be available in a range of designs. Where the holder 100 may be a commercial product, the holder 100 may comprise a durable or disposable material. The holder 100 may be single use and disposable, wherein the material may comprise a corrugated plastic or cardboard, as non-limiting examples. Where the holder 100 may be available near the point of purchase, such as at the conveyor belt, the holder 100 may comprise a durable hard material that may endure daily and repeated use.

As an illustrative example, a user may be able to keep the holder 100 in their car and easily grab it by the handle 120 to bring into a store. The user may place the holder 100 in their grocery cart to use while shopping, and then may transfer the holder 100 to the conveyor belt when loading bottles. The user may place the holder 100 in their trunk to stabilize the bottles while they drive. A handle 120 may allow for easy transportation between uses.

Figure 2B:
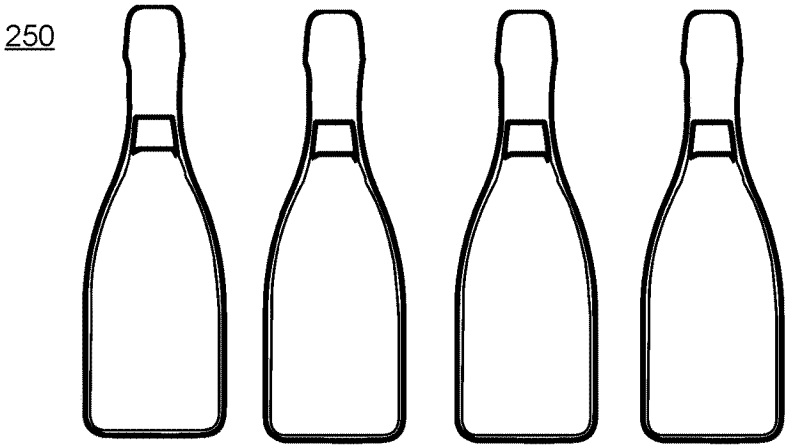
FIG. 2B illustrates exemplary curved-surface objects, according to some embodiments of the present disclosure.
Figure 2A:
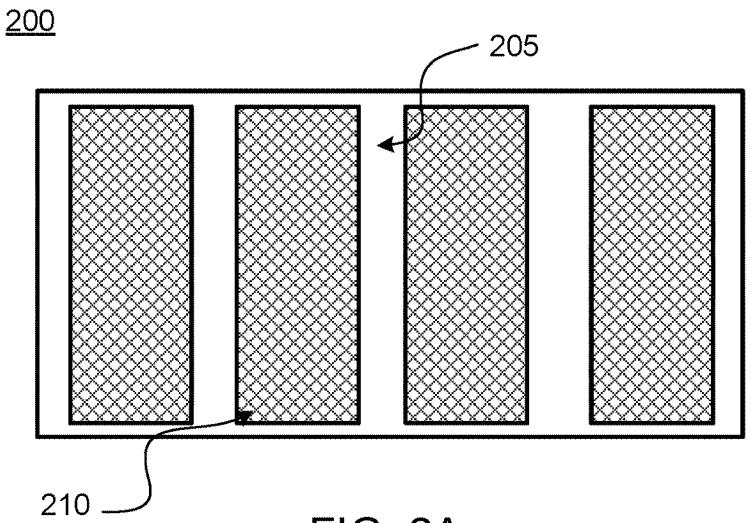
FIG. 2A illustrates an exemplary holder for curved-surface objects, according to some embodiments of the present disclosure.

Referring now to FIG. 2A, an exemplary holder 200 for curved-surface objects is illustrated. In some aspects, a holder 200 may comprise a frame 205 with openings 210 configured to accept curved-surface objects. In some embodiments, the openings 210 may comprise a backing that may prevent a curved-surface object from touching the movable surface, which may limit damage or breakage.

Referring now to FIG. 2B, exemplary curved-surface objects 250 are illustrated. In some embodiments, the curved-surface objects 250 may comprise large bottles of champagne, which may be prone to rolling when in a shopping cart, conveyor belt, or in the car. Champagne bottles are typically glass, may be heavy, and may be prone to exploding if shaken too much.

Figure 2C:
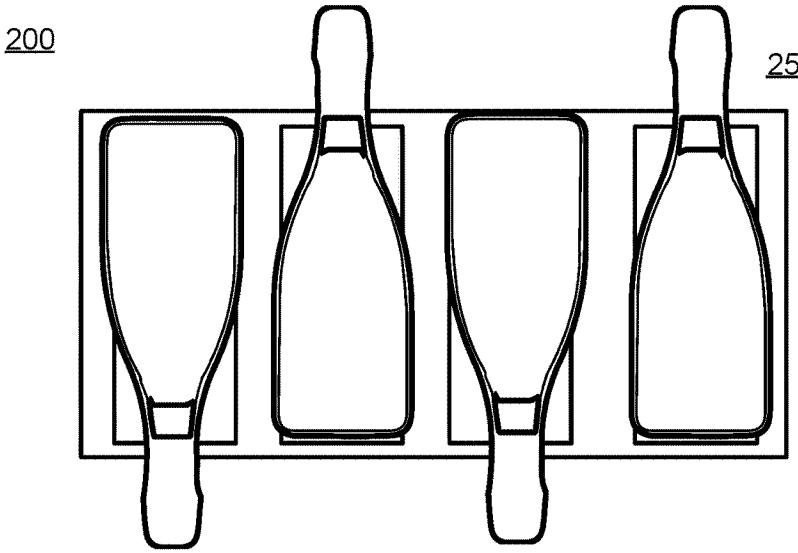
FIG. 2C illustrates an exemplary holder with curved-surface objects, according to some embodiments of the present disclosure.

Referring now to FIG. 2C, an exemplary holder 200 with curved-surface objects 250, according to some embodiments of the present disclosure. The champagne bottles may be offset when placed in the holder 200, which may be necessary where the openings may create an overlap. Because of the size, weight, and material of champagne bottles, the holder 200 may comprise a compressible material that may at least partially conform to the shape of the curved-surface objects 250, further limiting the risk of rolling.

Figure 3B:
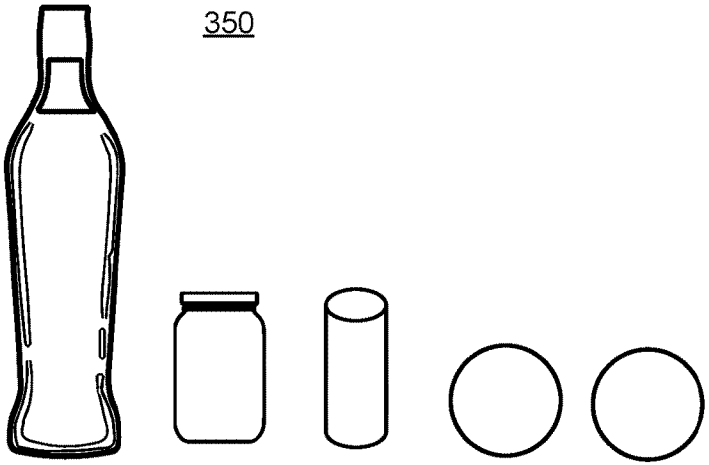
FIG. 3B illustrates exemplary curved-surface objects, according to some embodiments of the present disclosure.
Figure 3D:
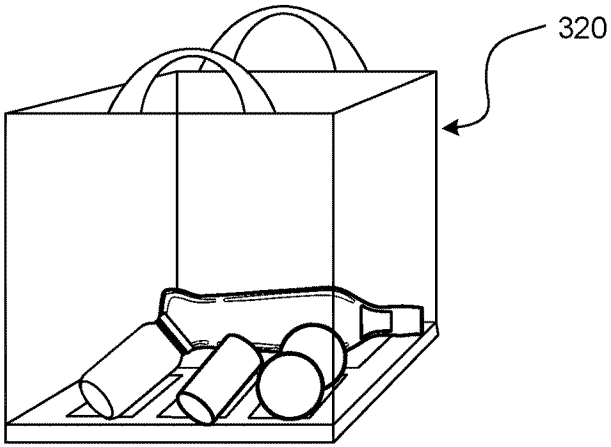
FIG. 3D illustrates a grocery bag with an exemplary holder and curved-surface objects, according to some embodiments of the present disclosure.
Figure 3A:
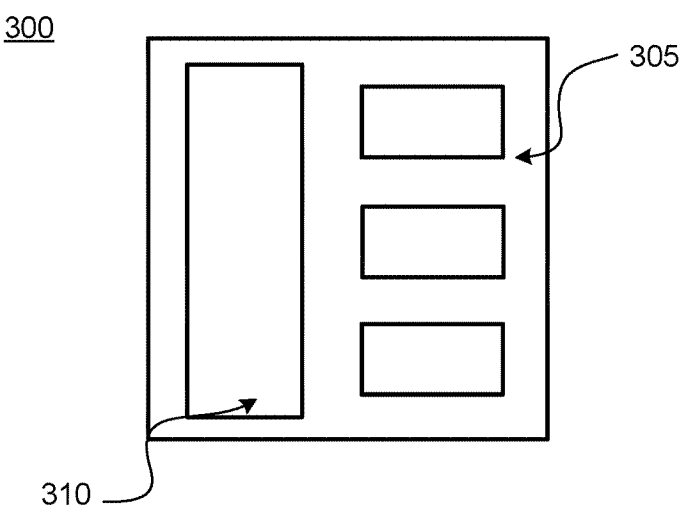
FIG. 3A illustrates an exemplary holder for curved-surface objects, according to some embodiments of the present disclosure.

Referring now to FIG. 3A, an exemplary holder 300 for curved-surface objects is illustrated. In some aspects, a holder 300 may comprise a frame 305 with openings 310 configured to accept curved-surface objects. In some aspects, the openings 310 may comprise a plurality of sizes that may accept and secure a range of products and curved-surface objects.

Referring now to FIG. 3B, exemplary curved-surface objects 350 are illustrated. In some aspects, the curved-surface objects 350 may comprise a bottled beverage, a jar of pickles, a can of tomato paste, and two melons. Placing the curved-surface objects 350 freely within a cart or basket may allow the bottle, jars, and can to damage and bruise the melons. The size of the bottle compared to the other products may increase the chance that bottle may roll off a movable surface or into a damaging object.

Figure 3C:
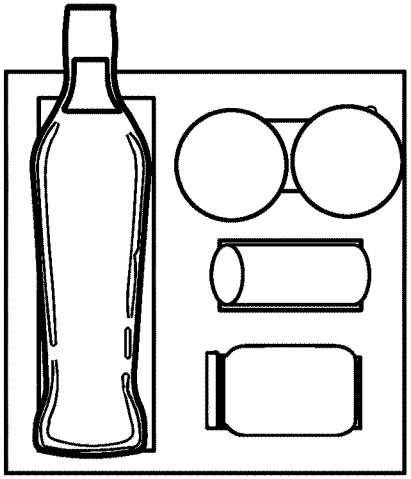
FIG. 3C illustrates an exemplary holder with curved-surface objects, according to some embodiments of the present disclosure.

Referring now to FIG. 3C, an exemplary holder 300 with curved-surface objects 350 is illustrated. In some aspects, a curved-surface object 350 may be larger than or similar in size to an opening 310, which may allow for a single curved-surface object 350. In some embodiments, multiple curved-surface objects 350, such as the melons, may fit within an opening 310. Spherical objects may benefit from sharing a rectangular opening 310, which may limit lateral movement within the opening 310. In some embodiments, the opening 310 may comprise a square, circle, or other geometric shape that may be suited for individual spherical objects, such as balls or fruits.

Referring now to FIG. 3D, a grocery bag 320 with an exemplary holder and curved-surface objects is illustrated. In some aspects, a user may place the holder at the bottom of a grocery bag, such as a reusable bag or paper bag. In some embodiments, the holder may comprise a rigid material that may provide a supportive base for the grocery bag 320. In some implementations, the holder may be available at checkout, which may allow for easy access during packing of the purchased goods. The holder may be disposable or adjustable, such as illustrated and described with FIG. 9.

Figure 4B:
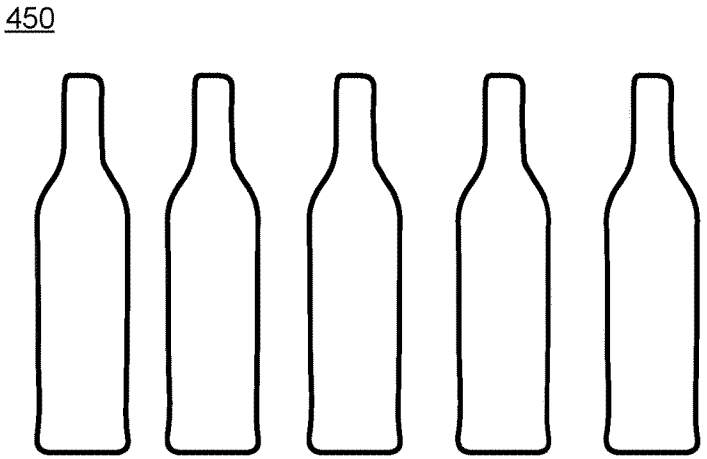
FIG. 4B illustrates exemplary curved-surface objects, according to some embodiments of the present disclosure.
Figure 4D:
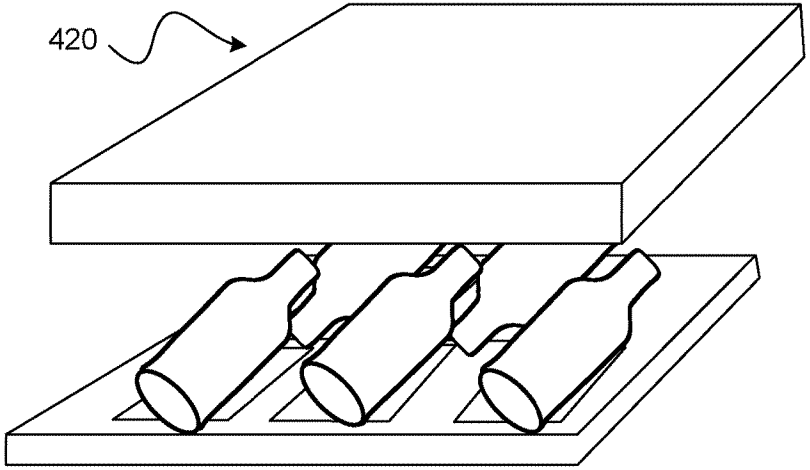
FIG. 4D illustrates a cover for an exemplary holder with curved-surface objects, according to some embodiments of the present disclosure.
Figure 4A:
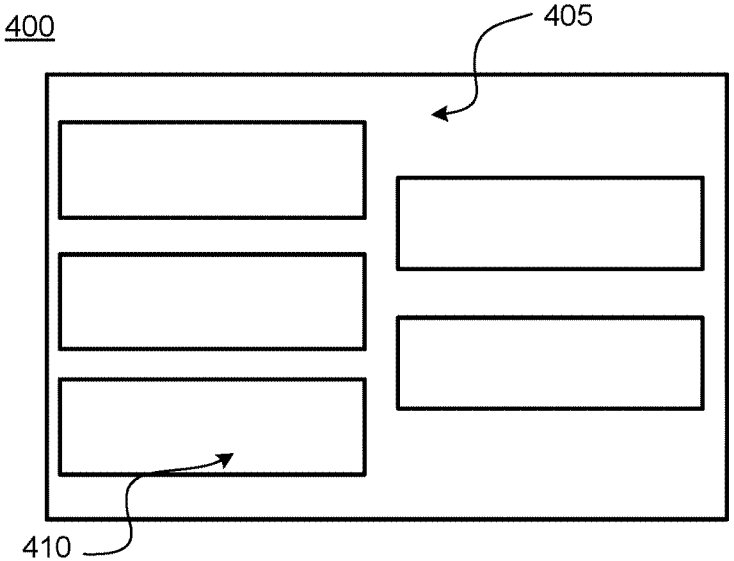
FIG. 4A illustrates an exemplary holder for curved-surface objects, according to some embodiments of the present disclosure.

Referring now to FIG. 4A, an exemplary holder 400 for curved-surface objects is illustrated. In some aspects, a holder 400 may comprise a frame 405 with openings 410 configured to accept curved-surface objects. In some aspects, the openings 410 may be staggered to accommodate more curved-surface objects. In some embodiments, the openings 410 may be the same shape and size, which may be preferable where the products may be a standard shape and size, such as wine bottles, water bottles, and produce, as non-limiting examples.

Referring now to FIG. 4B, exemplary curved-surface objects 450 are illustrated. In some embodiments, a user may be purchasing or transporting bottles of wine with limited space. For example, the user may be transporting bottles of wine in his trunk, and free rolling bottles may be susceptible to damage or breakage during the car ride. Even while kept in a bag, the bottles of wine may roll.

Figure 4C:
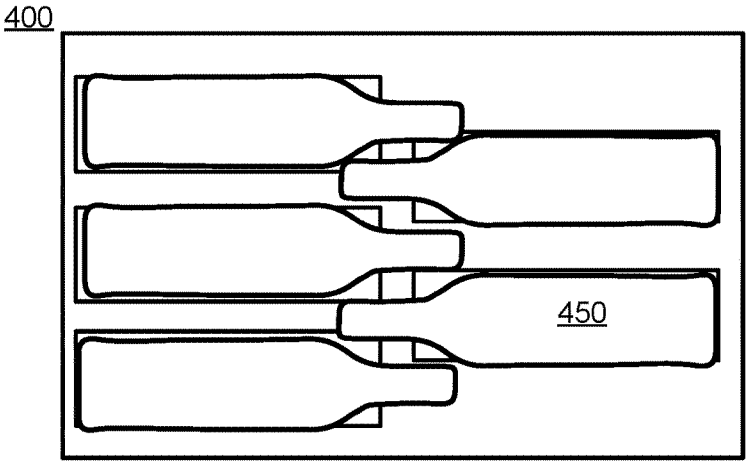
FIG. 4C illustrates an exemplary holder with curved-surface objects, according to some embodiments of the present disclosure.

Referring now to FIG. 4C, an exemplary holder 400 with curved-surface objects 450 is illustrated. In some implementations, the curved-surface objects 450 may comprise wine bottles staggered and facing inward. Placing the bottles inward may limit extension of the curved-surface objects 450 beyond the frame 405 of the holder 400. Keeping the bottles within the confines of the holder 400 may be preferable in small spaces or where proximate objects may knock into the holder 400.

For example, the user may be transporting the bottles of wine in a small convertible trunk with limited room. As another example, the user may be transporting the bottles of wine in the back of an SUV that may also hold sports equipment and luggage that may catch on the necks of the bottles if they were facing outward. In some aspects, the holder 400 may comprise a secondary fastener, such as straps, that may secure the curved-surface objects 450 to the holder 400. This may increase protection from rolling and allow for extended and erratic motion of the movable surface. In some embodiments, the holder 400 may have a container to seal the curved-surface objects in place.

Referring now to FIG. 4D, a cover 420 for an exemplary holder with curved-surface objects is illustrated. In some aspects, such as described in the example above, guarding the curved-surface objects from nearby objects or features may be useful. In some embodiments, securing a cover 420 over the holder may allow for more efficient use of storage space, such as by allowing for stacking of other holders or other objects on top of the cover 420.

Figure 5B:
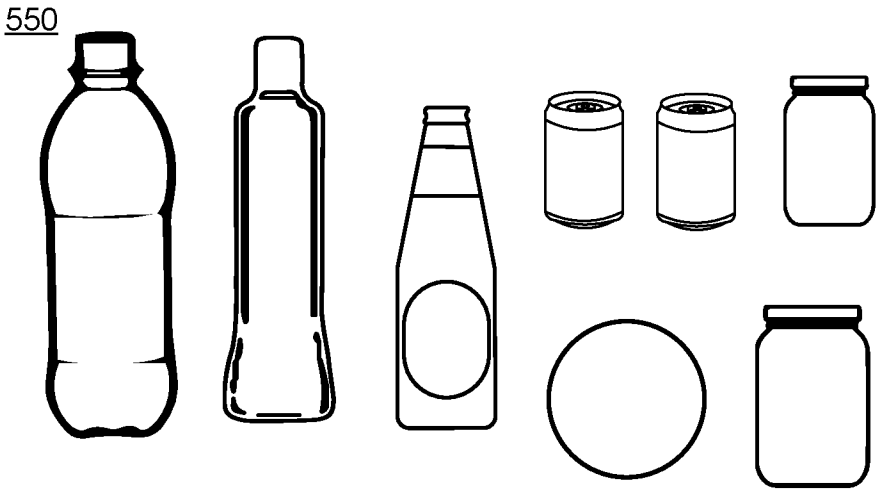
FIG. 5B illustrates exemplary curved-surface objects, according to some embodiments of the present disclosure.
Figure 5A:
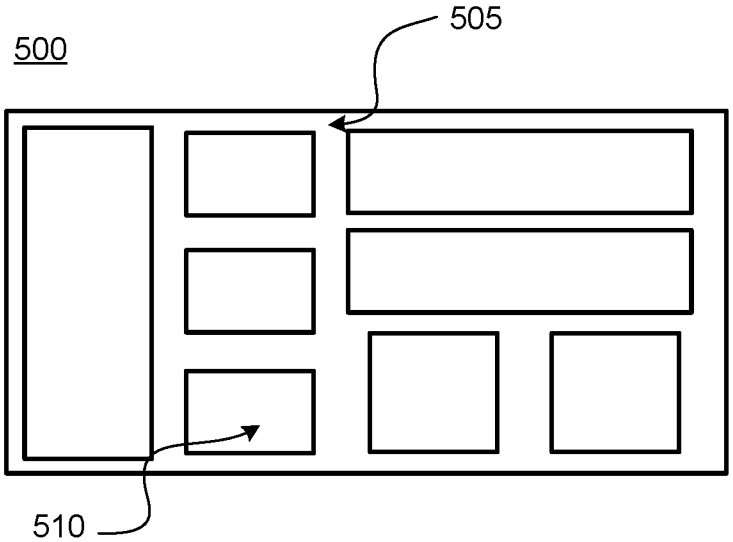
FIG. 5A illustrates an exemplary holder for curved-surface objects, according to some embodiments of the present disclosure.

Referring now to FIG. 5A, an exemplary holder 500 for curved-surface objects is illustrated. In some aspects, a holder 500 may comprise a frame 505 with openings 510 configured to accept curved-surface objects. In some embodiments, the openings 510 may comprise a range of shapes and sizes. In some implementations, the holder 500 may be large enough to accommodate a load of groceries. The holder 500 may be configured to fit on a particular movable surface, such as a conveyor belt, shopping cart, car floor, or car trunk. In some aspects, the size of the frame 505 may be specific to a brand of cart or make and model of a car, which may allow for a secure fit of the holder 500 onto the movable surface.

In some embodiments, a store may offer a holder 500 at different locations, such as at the point of sale, near inventory that may need a holder 500, or at the entrance. In some aspects, the holder 500 may be provided by a store, similar to a shopping cart or basket, and must be returned before leaving. In some implementations, the holder 500 may be disposable and offered near curved-surface inventory, such as bottles or produce. In some embodiments, the holder 500 may be reusable and offered for sale, similarly to reusable grocery bags.

Referring now to FIG. 5B, exemplary curved-surface objects 550 are illustrated. In some aspects, curved-surface objects 550 may comprise typical grocery or picnic items, such as a bottle of soda, a bottle of alcohol, a bottle of ketchup, soda cans, a jar of mustard, a jar of mayonnaise, and round watermelon. This type of assortment may be common inventory when packing or shopping for a picnic, camping trip, or trip to the beach.

Figure 5C:
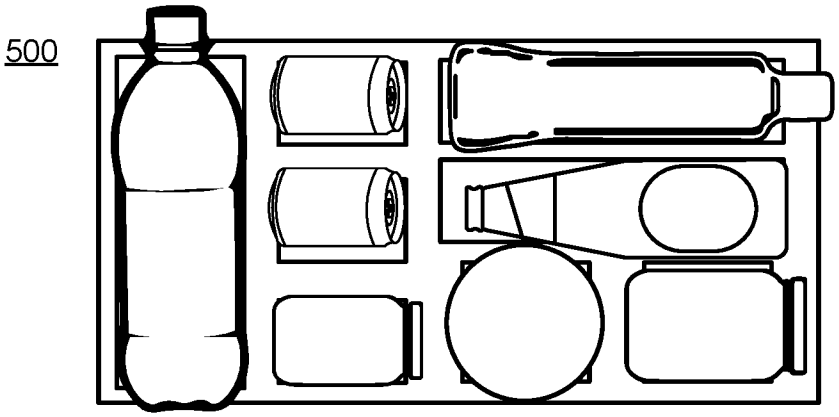
FIG. 5C illustrates an exemplary holder with curved-surface objects, according to some embodiments of the present disclosure.

Referring now to FIG. 5C, an exemplary holder 500 with curved-surface objects 550 is illustrated. The curved-surface objects 550 may be arranged as they fit, and some openings 510 may accept different shapes within the same space. For example, a round watermelon and ajar of mayonnaise may fit in the same shape and size opening 510. In some aspects, the holder 500 may be rigid enough to allow for transfer of holder 500 from one movable surface to another movable surface without having to remove and replace the curved-surface objects 550. In some implementations, a holder 500 may be rolled for storage to protect the openings 510 while not in use.

Figure 6:
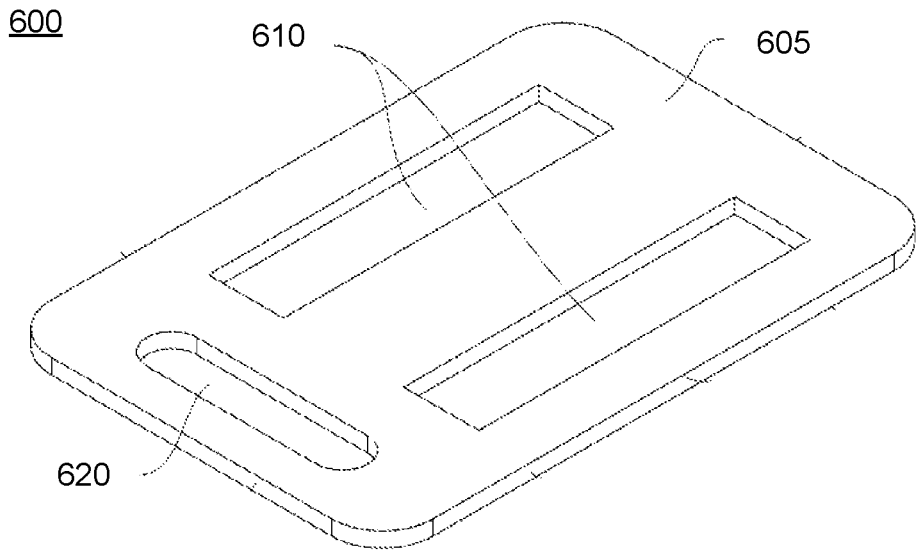
FIG. 6 illustrates a top isometric view of an exemplary holder for curved-surface objects, according to some embodiments of the present disclosure.

Referring now to FIG. 6, a top isometric view of an exemplary holder 600 for curved-surface objects is illustrated. In some aspects, a holder 600 may comprise a frame 605 with openings 610 configured to accept curved-surface objects. In some embodiments, the holder 600 may comprise a handle 620 that may allow for convenient portability. In some implementations, a curved-surface object may have contact with the movable surface when placed in the opening 610. The opening 610 may comprise a reinforcing frame to limit damage or wear over time that may be caused by the weight of the curved-surface objects.

Figure 7:
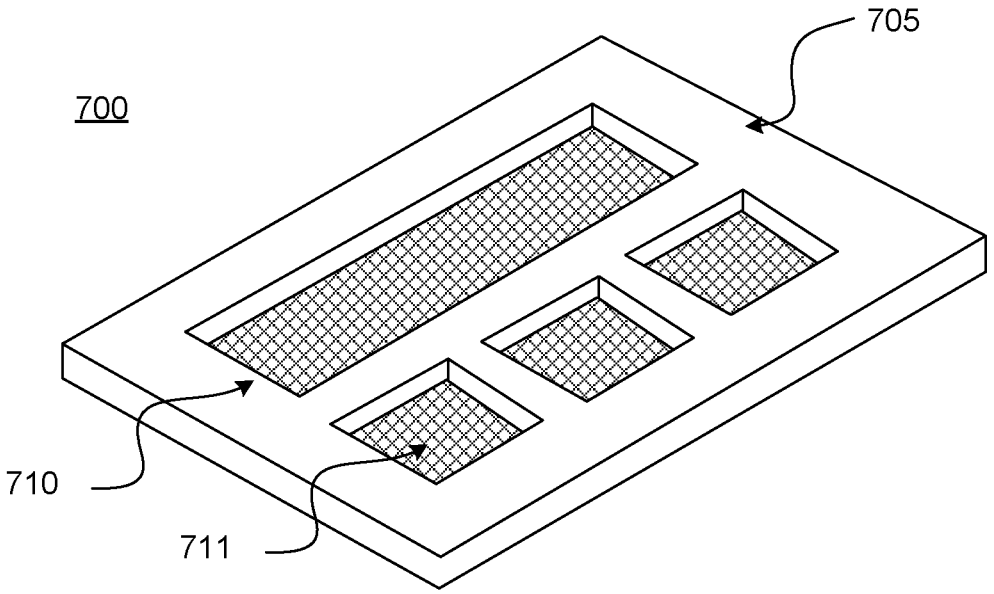
FIG. 7 illustrates a top isometric view of an exemplary holder for curved-surface objects, according to some embodiments of the present disclosure.

Referring now to FIG. 7, a top isometric view of an exemplary holder 700 for curved-surface objects is illustrated. In some aspects, a holder 700 may comprise a frame 705 with openings 710 configured to accept curved-surface objects. In some embodiments, the openings 710 may comprise a backing 711, wherein the backing 711 may provide a protective layer between the movable surface and the curved-surface objects. The backing 711 may comprise a textured surface to limit sliding. The backing 711 may comprise a soft or cushioned material that may limit damage to curved-surface objects, which may be particularly useful for breakable objects, such as jars and bottles. In some embodiments, the frame 705 may comprise walls along the exterior that may create additional support for the holder. For example, such as illustrated in FIG. 3D, walls may be useful when the holder 700 may be inserted at the base of a grocery bag.

Figure 8:
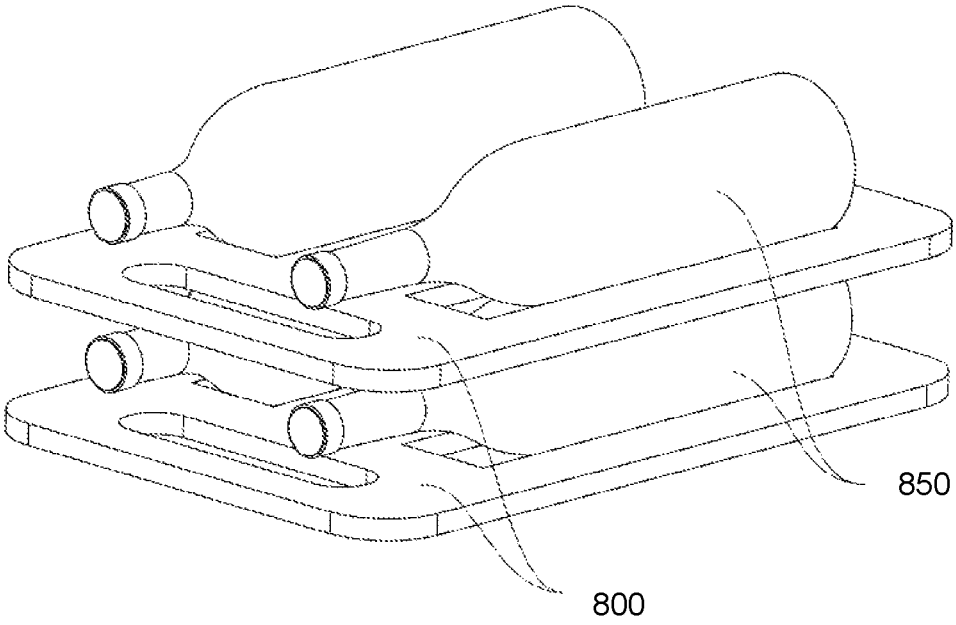
FIG. 8 illustrates a top isometric view of stacked exemplary holders with curved-surface objects, according to some embodiments of the present disclosure.

Referring now to FIG. 8, a top isometric view of stacked exemplary holders with curved-surface objects is illustrated. In some aspects, a holder 800 may comprise a frame with openings configured to accept curved-surface objects. In some embodiments, a top holder 800 may stabilize a top set of curved-surface objects 850, and a bottom holder 800 may stabilize a bottom set of curved-surface objects 850, wherein the top and bottom holders 800 may be stackable.

In some aspects, the openings in stacked holders 800 may be located over each other, wherein curved-surface objects 850 may be located on top of each other. The holders 800 may comprise a thickness substantial enough to prevent touching of the curved-surface objects 850. In some implementations, the openings may comprise a backing, such as illustrated in FIG. 7. A backing may prevent touching of stacked curved-surface objects 850.

Figure 9:
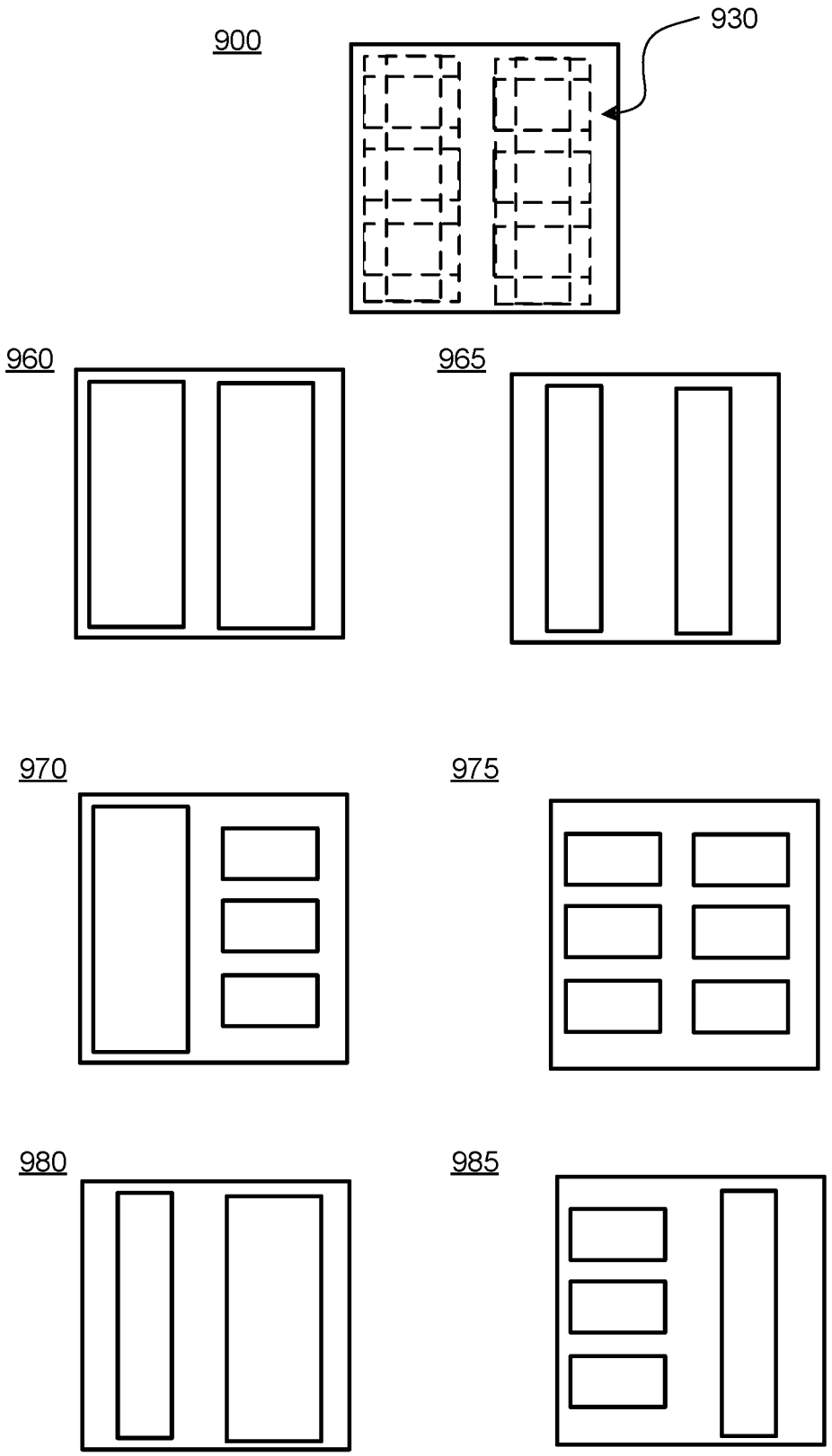
FIG. 9 illustrates an exemplary holder for curved-surface objects with removable panels, according to some embodiments of the present disclosure.

Referring now to FIG. 9, an exemplary holder 900 for curved-surface objects with removable panels is illustrated. In some aspects, a holder 900 may comprise a frame with a plurality of removable panels 930, wherein removing each of the plurality of removable panels 930 may create an opening configured to stabilize a curved-surface object. In some embodiments, the removable panels 930 may be variable, wherein removing different sized removable panels 930 may create a range of openings. Variable sizes may adapt a single holder 900 to a range of configurations.

As illustrative examples, removal of the largest removable panels 930 may create two large openings 960, such as may be useful for two magnums of wine. Removal of the long removable panels 930 may create two long, thin openings 965, which may be useful for two standard bottles of wine. Removal of one large removable panel and three smaller panels may create one large opening and three smaller ones 970, which may be useful for stabilizing a large bottle and three smaller jars. Removal of six small panels may create six small openings 975, which may be useful for stabilizing produce. Removal of one large removable panel and one long removable panel may create two openings 980, such as one for a bottle of soda and a bottle water. Removal of three small panels and one long panel may create four openings 985, which may be useful for a large produce, such as a papaya, and small cans or jars.

Allowing for variable sizes within a holder 900 may allow for use of the same type of holder 900 for a range of curved-surface objects. In some embodiments, the removable panels 930 may be one-time use and removable once, wherein the removable panels 930 may not be replaceable. Such embodiments may be useful where the holder 900 may be disposable, such as may be offered while shopping at a grocery store, wine store, or other package store.

Figure 10A:
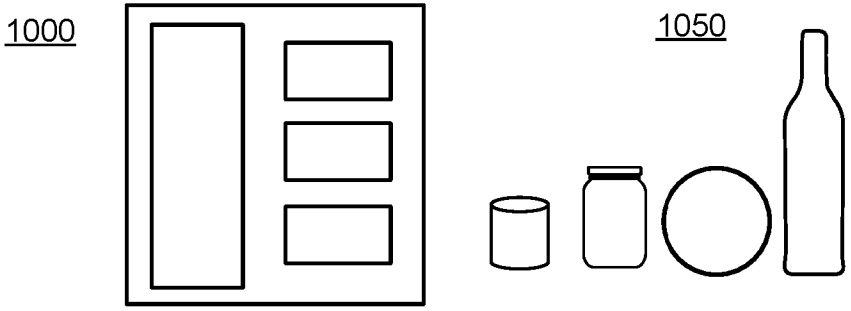
FIG. 10A illustrates an exemplary holder for curved-surface objects configured to fit in a grocery cart, according to some embodiments of the present disclosure.
Figure 10A:
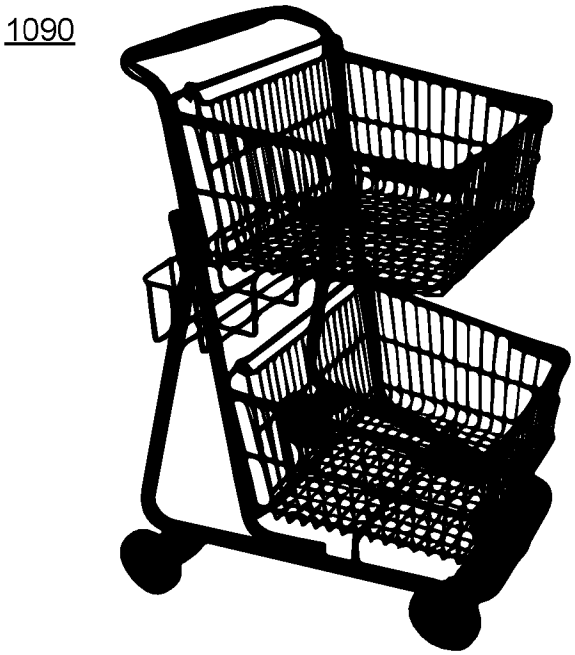

Referring now to FIG. 10A, an exemplary holder 1000 for curved-surface objects 1050 configured to fit in a grocery cart 1090 is illustrated, wherein the grocery cart 1090 may comprise the movable surface. In some aspects, the holder 1000 may comprise specifications based on a grocery cart 1090, wherein the holder 1000 may be at least smaller than the grocery cart 1090. In some embodiments, the holder 1000 may be a length or width of a standard cart, which may allow for a secure fit, further limiting shifting of the curved-surface objects 1050.

Figure 10B:
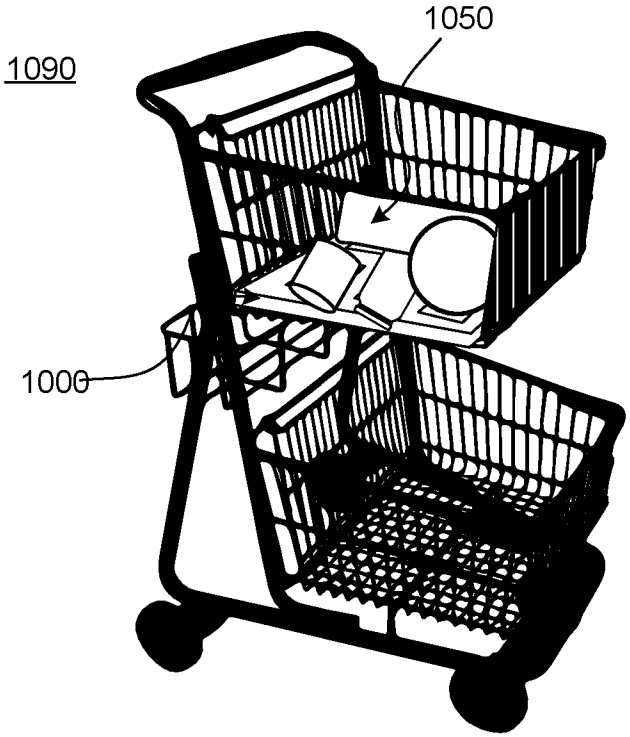
FIG. 10B illustrates a grocery cart with cutout to show an exemplary holder with curved-surface objects, according to some embodiments of the present disclosure.

Referring now to FIG. 10B, a grocery cart 1090 with cutout to show an exemplary holder 1000 with curved-surface objects 1050 is illustrated. In some aspects, the holder 1000 may be custom designed based on the grocery cart 1090. In some embodiments, one or both the holder 1000 and the grocery cart 1090 may comprise a locking mechanism that may further secure the holder 1000 to the movable surface of the grocery cart 1090. In some aspects, the holder 1000 may be configured based on the types and shapes of curved-surface objects 1050 offered at a store.

Figure 11A:
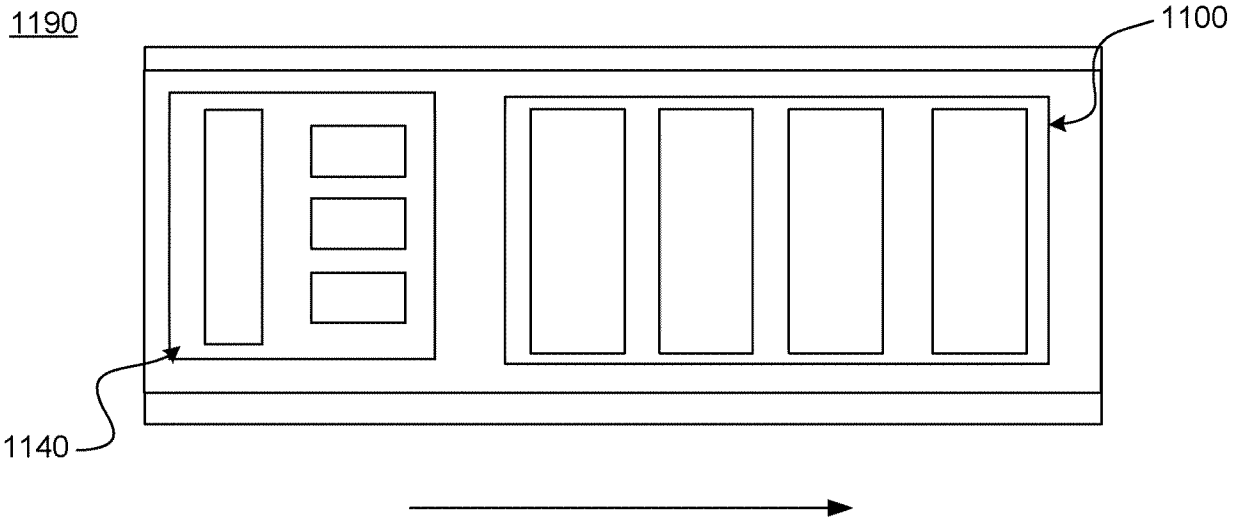
FIG. 11A illustrates exemplary holders for curved-surface objects configured to fit on a conveyor belt, according to some embodiments of the present disclosure.

Referring now to FIG. 11A, exemplary holders 1100, 1140 for curved-surface objects configured to fit on a conveyor belt 1190 are illustrated, wherein the conveyor belt 1190 comprises the movable surface. In some embodiments, the holders 1100, 1140 may comprise different configurations, which may allow a user to select the most appropriate types. In some implementations, the holders 1100, 1140 may comprise a shape that fits the conveyor belt 1190.

Figure 11B:
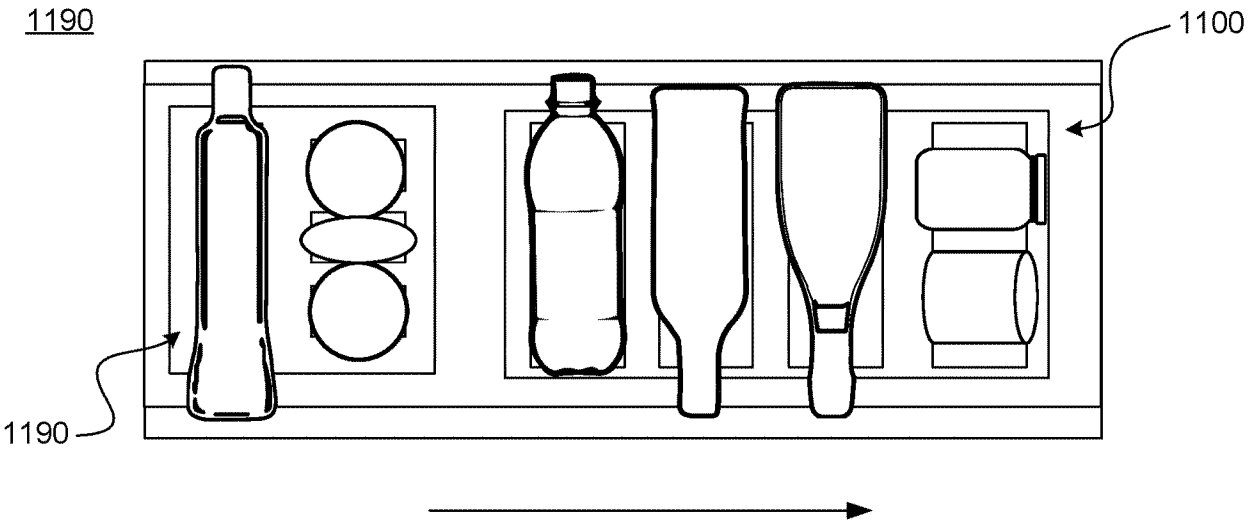
FIG. 11B illustrates a conveyor belt with curved-surface objects on exemplary holders, according to some embodiments of the present disclosure.

Referring now to FIG. 11B, a conveyor belt 1190 with curved-surface objects on exemplary holders 1100, 1140 is illustrated. In some aspects, the holders 1100, 1140 available may be based on the types and sizes of products sold at the store. For example, wine bottle sized openings may be appropriate at stores that primarily sell wine. As another example, openings suited for produce may be appropriate at stores that primarily sell produce. Mixed openings may be useful for general grocery stores.

Figure 12A:
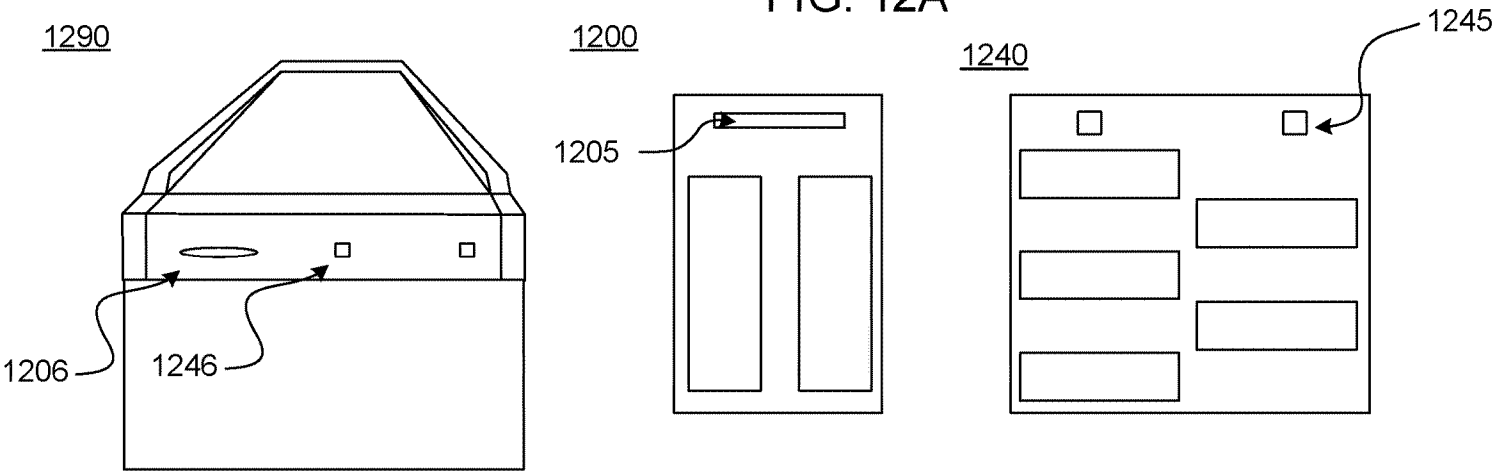
FIG. 12A illustrates exemplary holders for curved-surface objects comprising a hanging mechanism, according to some embodiments of the present disclosure.

Referring now to FIG. 12A, exemplary holders 1200, 1240 for curved-surface objects comprising a hanging mechanism 1205, 1245 are illustrated, wherein the movable surface may comprise a conveyor belt 1290. In some embodiments, the holders 1200, 1240 may be available at a point of sale for consumers to use as the check out on a conveyor belt 1290. For convenience, the conveyor belt 1290 may comprise complementary hanging devices 1206, 1246 that may allow for hanging on a vertical surface.

Figure 12B:
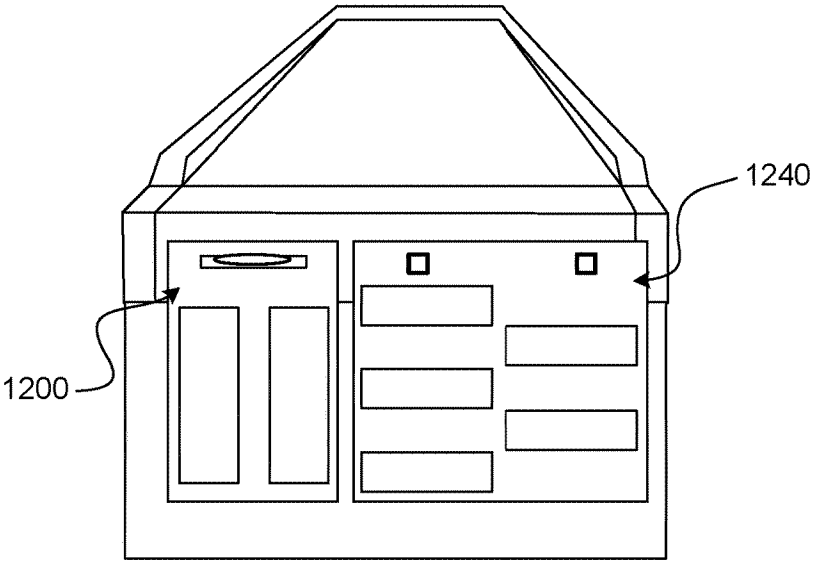
FIG. 12B illustrates exemplary holders for curved-surface objects hanging from a conveyor belt, according to some embodiments of the present disclosure.

Referring now to FIG. 12B, exemplary holders 1200, 1240 for curved-surface objects hanging from a conveyor belt 1290 are illustrated. In some aspects, holders 1200, 1240 may be provided by a store to encourage safe loading of products onto the conveyor belt 1290. For ease of access and storage, while not in use, the holders 1200, 1240 may hang from the start of the conveyor belt 1290. In some aspects, the holders 1200, 1240 may be hung near other points of use, such as by an entrance, near grocery carts or baskets, or near curved-surface objects, as non-limiting examples. For example, the holders 1200, 1240 may be hung near the wine and beer section, the soda section, or the produce section.

Conclusion

A number of embodiments of the present disclosure have been described. While this specification contains many specific implementation details, there should not be construed as limitations on the scope of any disclosures or of what may be claimed, but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous.

Moreover, the separation of various system components in the embodiments described above should not be understood as requiring such separation in all embodiments, and it should be understood that the described program components and systems can generally be integrated together in a single software product or packaged into multiple software products.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order show, or sequential order, to achieve desirable results. In certain implementations, multitasking and parallel processing may be advantageous. Nevertheless, it will be understood that various modifications may be made without departing from the spirit and scope of the claimed disclosure.

What is claimed is:

1. A holder for curved-surface objects comprising:

a frame comprising a substantially planar shape comprising at least one opening, wherein each of the at least one opening comprises at least one larger removable panel and a plurality of smaller removable panels, wherein removing different-sized removable panels creates variable-sized openings within each of the at least one opening;

a movable surface comprising a conveyor belt; and at least one removable curved-shaped object prone to rolling, wherein at least a portion of the variable-sized openings stabilizes the removable curved-surface object when the frame is placed on the movable surface, wherein the stabilizing limits rolling of the curved-surface objects when the movable surface is moving.

2. The holder of claim 1, wherein the frame comprises a disposable material.

3. The holder of claim 1, wherein the frame comprises a reusable material.

4. The holder of claim 1, wherein the different-sized removable panels are one-time use and not replaceable to cover the opening.

5. The holder of claim 1, wherein the different-sized removable panels are replaceable to recover the variable-sized openings.

6. The holder of claim 1, wherein the plurality of smaller removable panels comprise a plurality of one or both shapes and sizes.

7. The holder of claim 1, wherein the holder is stackable on a second holder.

8. The holder of claim 1, wherein each of the plurality of openings comprises a reinforcing frame around at least a portion of the opening.

9. The holder of claim 1, wherein each of the plurality of openings comprises a backing, wherein the backing provides a protective layer between the movable surface and the curved-surface objects.

* * * * *